United States Patent [19]

Bellinger et al.

[11] 4,230,437

[45] Oct. 28, 1980

[54] COMPRESSOR SURGE CONTROL SYSTEM

[75] Inventors: Robert M. Bellinger; Hadwen A. Clayton, both of Bartlesville, Okla.

[73] Assignee: Phillips Petroleum Company, Bartlesville, Okla.

[21] Appl. No.: 48,969

[22] Filed: Jun. 15, 1979

[51] Int. Cl.[3] ..... F04D 27/02

[52] U.S. Cl. ..... 415/1; 415/11; 415/37; 415/DIG. 1

[58] Field of Search ..... 415/11, 17, 37, DIG. 1

[56] References Cited

U.S. PATENT DOCUMENTS

| | | | |
|---|---|---|---|
| 2,470,565 | 5/1949 | Loss | 415/11 X |
| 2,661,145 | 12/1953 | Heineman | 415/11 |
| 2,933,236 | 4/1960 | Mathieson | 415/11 |
| 2,986,327 | 5/1961 | Hunter | 415/11 |
| 3,240,422 | 3/1966 | Pettersen et al. | 415/1 |
| 3,276,674 | 10/1966 | Hens | 415/1 |
| 3,292,845 | 12/1966 | Hens et al. | 415/1 |
| 3,292,846 | 12/1966 | Harper et al. | 415/1 |
| 3,876,326 | 4/1975 | Weitz | 415/17 |
| 4,139,328 | 2/1979 | Kuper et al. | 415/1 |
| 4,156,578 | 5/1979 | Agar et al. | 415/1 |

*Primary Examiner*—Everette A. Powell, Jr.

[57] ABSTRACT

A compressor surge control system is provided for a compressor system in which recirculation of gas from the discharge outlet of the compressor to the suction inlet of the compressor is utilized to prevent surging of the compressor. The recirculation of gas from the discharge outlet of the compressor to the suction inlet of the compressor is substantially minimized by using a first controller to provide a floating set point for a second controller. This reduced recirculation substantially increases the efficiency of the compressor system.

8 Claims, 3 Drawing Figures

COMPRESSOR SURGE CONTROL SYSTEM

This invention relates to surge control of a compressor system. In one aspect, this invention relates to method and apparatus for substantially increasing the efficiency of a compressor system while substantially minimizing the possibility of damage to the compressor system due to surging.

Figure 1:
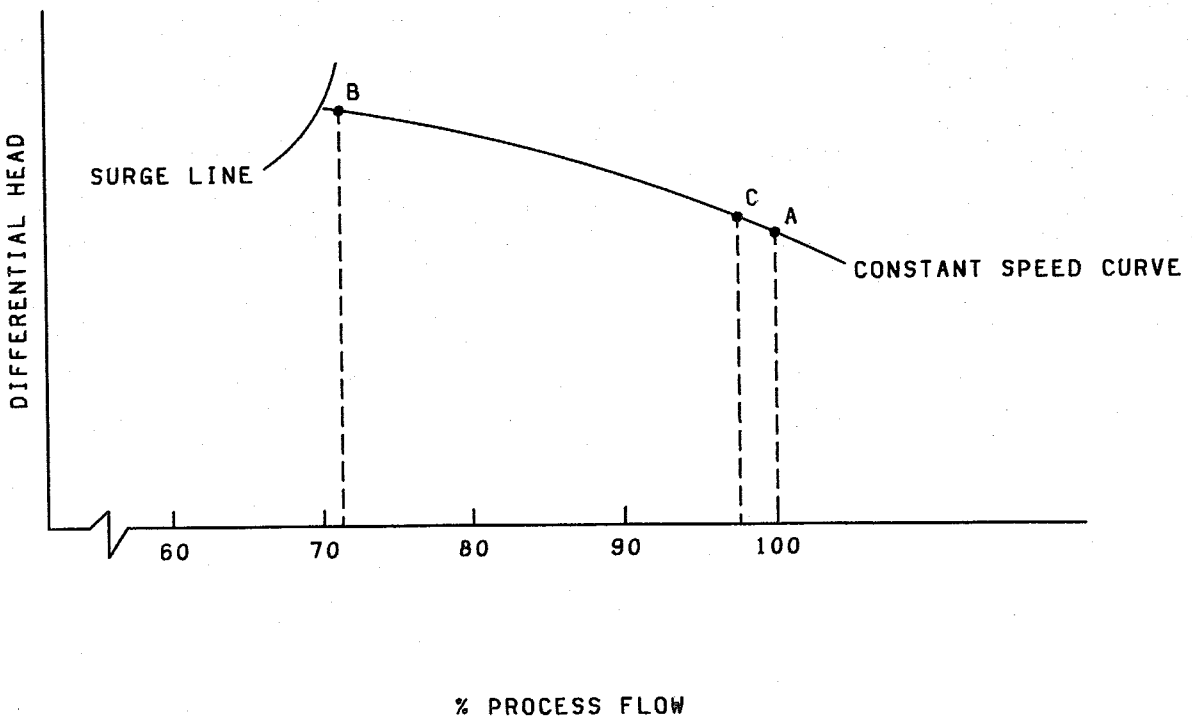
Figure 2:
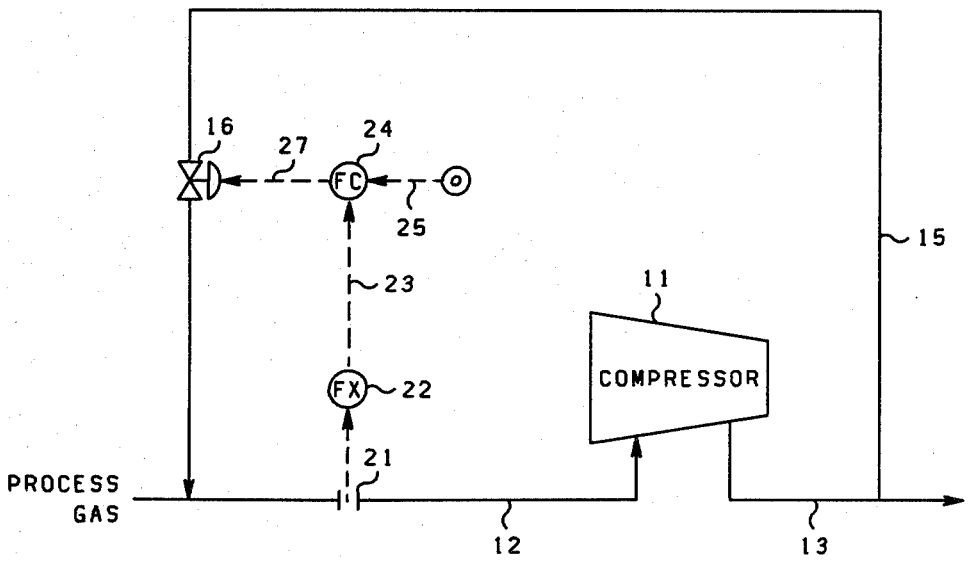
Figure 3:
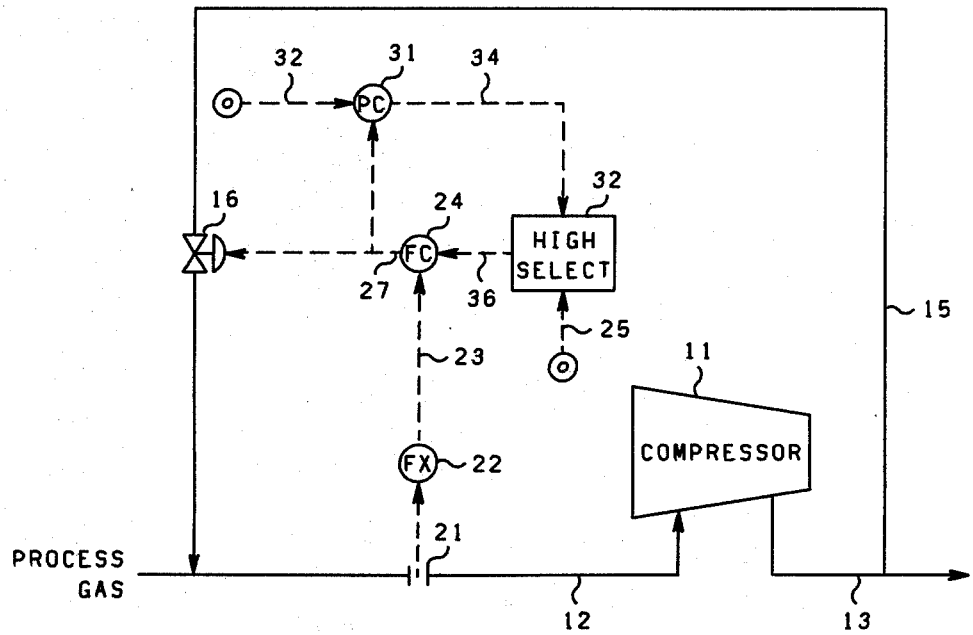

The drawings in which:

FIG. 1 is a typical constant speed curve for a compressor;

FIG. 2 is a diagrammatic representation of a prior art surge control system for a compressor; and FIG. 3 is a diagrammatic representation of the surge control system for a compressor of the present invention, will be utilized to describe the problem addressed by the present invention, illustrate a prior art solution to the problem addressed by the present invention and illustrate the improvement presented over the prior art by the present invention.

Referring now to FIG. 1, a compressor will normally be designed for a particular process in such a manner that the compressor operates at point A, which corresponds to 100 percent process flow. The term process flow refers to the flow of gas to the compressor and thus 100 percent process flow corresponds to the normal operating conditions of the process. If process flow is impeded, the operating point of the compressor moves to the left, as illustrated in FIG. 1, towards the surge line for the compressor. Equipment failures and other similar circumstances may cause the process flow rate to change so rapidly that there is an overshoot across the surge line which will subject the compressor to possible damage. When process flow is impeded, the flow from the discharge output of the compressor is typically recycled to the suction inlet of the compressor to avoid the condition where the operating point of the compressor passes the surge line. A prior art control system for manipulating the recirculation of gas from the discharge outlet of the compressor to the suction inlet of the compressor is illustrated in FIG. 2.

Referring now to FIG. 2, process gas is provided to the compressor 11 through conduit means 12. Gas is discharged from the compressor 11 through conduit means 13. Gas may be recycled from the discharge outlet of the compressor 11 to the suction inlet of the compressor 11 through conduit means 15 by opening pneumatic control valve 16, which is operatively located in conduit means 15. The recirculation of gas from the discharge outlet of the compressor 11 to the suction inlet of the compressor 11 is controlled by utilizing the combination of the flow sensor 21 and the flow transducer 22 to provide an output signal 23 which is representative of the flow rate of the process gas flowing through conduit means 12. Signal 23 is provided as an input signal to the flow controller 24. The flow controller 24 is also provided with a set point signal 25 which is representative of the desired flow rate of the gas flowing through conduit means 12. In response to signals 23 and 25, the flow controller 24 provides an output signal 27 which is responsive to the difference between signals 23 and 25. The pneumatic control valve 16 is manipulated in response to signal 27 to thereby maintain the actual flow of process gas through the conduit means 12 equal to the flow rate represented by the set point 25.

The efficiency of the compressor system is reduced when gas must be recirculated from the discharge outlet of the compressor 11 to the suction inlet of the compressor 11. It would thus be desirable that the set point 25 would be equal to a process flow which corresponds to point B on the constant speed curve for the compressor 11. In this manner, recirculation of gas from the discharge outlet of the compressor 11 to the suction inlet of the compressor 11 would be substantially minimized. However, if the set point 25 is set at point B, it is possible that the process flow rate may change so quickly that the control system will not have time to react to prevent the operating point of the compressor from passing the surge line. Possible damage to the compressor may occur. To avoid this possibility, it has been common in the past to set the set point 25 at point C on the constant speed operating curve, which is very close to the normal operating point for the compressor 11. With the set point at point C, gas may be recirculated from the discharge outlet of the compressor 11 to the suction inlet of the compressor 11 substantially 100 percent of the time. However, the time for the control system to react will be increased and the control system will be able to react to a process flow change to prevent the operating point of the compressor from going past the surge line. However, the constant recirculation of gas results in a substantial loss of energy and a substantial loss in the efficiency of the compressor system. It is thus an object of this invention to provide method and apparatus for substantially increasing the efficiency of a compressor system by minimizing the recycling of gas from the discharge outlet of the compressor to the suction inlet of the compressor while substantially minimizing the possibility of damage to the compressor system due to surging.

In accordance with the present invention, method and apparatus is provided whereby a floating set point is utilized to control the position of the valve through which gas is recirculated from the discharge outlet of the compressor to the suction inlet of the compressor. The floating set point is generated by utilizing a slow controller to compare a signal representative of the actual valve position to a set point signal which is equal to a signal which would fully close the valve. If process flow to the compressor should change, a fast controller is utilized to immediately open the control valve. The slow controller then acts to slowly change the set point for the fast controller such that the control valve is again closed for the new operating conditions. The immediate response to process condition changes prevents a high rate of change in flow from causing an overshoot of the surge line. The use of the variable set point minimizes the recirculation of the gas from the discharge output of the compresor to the suction inlet of the compressor. A set point close to the surge line is utilized to set a minimum flow rate to the compressor.

Other objects and advantages of the invention will be apparent from the foregoing brief description of the invention and from the claims as well as from the detailed description of the invention which is provided hereinafter.

The terms "fast controller" and "slow controller" are used extensively to describe the present invention. The actual time constants set into the controller may vary considerably depending on system parameters such as valve size. Any desired relationship between the reaction time of the fast controller and the reaction time of the slow controller can be utilized so long as the fast controller does react more quickly to a process change than the slow controller. Preferably, the fast controller is tuned to react from about three to about seven times faster than the slow controller. More preferably, the fast controller is tuned to react five times faster than the slow controller.

Referring now to FIG. 3, the position controller 31 and the high select 32 have been added to the prior art control system illustrated in FIG. 2. The position controller 31 is provided with signal 27 from the flow controller 24. The position controller 31 is also provided with the set point signal 32 which will preferably be representative of the value of signal 27 which will maintain the control valve 16 substantially fully closed. Responsive to signals 27 and 32, the position controller 31 provides an output signal 34 which is responsive to the difference between signals 27 and 32. Signal 34 is provided as an input to the high select 32. The high select 32 is also provided with a set point signal 25 which has been previously described. The higher of signals 34 and 25 is provided as a set point signal 36 to the flow controller 24.

Both the flow controller 24 and the position controller 31 are direct acting controllers. By direct acting controller, it is meant that as the measurement signals to the controllers increase, the output signals from the controllers will increase. The control valve 16 is designed to fail open and thus the control valve 16 is fully closed when the control signal 27 is at substantially its highest level. The flow controller 24 is a fast controller, while the position controller 31 is a slow controller.

As an example of the operation of the control system illustrated in FIG. 3, consider the situation where the signals may range from 3 to 15 pounds. The pneumatic control valve 16 is fully closed when signal 27 is equal to 15 pounds and is fully open when signal 27 is equal to 3 pounds. The set point signal 32 will thus be equal to 15 pounds. Assume that the compressor 11 is operating at point A on the constant speed curve illustrated in FIG. 1. The signal 23 will be representative of 100 percent process flow, signal 27 will be substantially equal to 15 pounds and signal 34 will be scaled so as to be representative of 100 percent process flow. The set point signal 25 is set at point B on the constant speed operating curve and thus signal 34 will be selected to be supplied as the set point signal 36 to the flow controller 24. A balanced condition occurs when signal 34 is equal to and tracking signal 23 and signal 27 is equal to signal 32. Under these conditions, the pneumatic control valve 16 is fully closed and no gas will recirculate from the discharge outlet of the compressor 11 to the suction inlet of the compressor 11.

Now consider the situation in which the flow of process gas to the inlet of the compressor 11 changes to 95 percent process flow. Flow controller 24 is a fast controller and a reduction in the flow represented by signal 23 will cause the pneumatic control valve 16 to open very quickly. As has been previously stated, the pressure controller 31 is a slow controller. Since signal 27 will decrease because of the decrease in the flow represented by signal 23, the output signal from the pressure controller 31 will begin to decrease slowly. The output signal 34 from the position controller 31 will decrease until it is substantially representative of 95 percent process flow. Signal 34 will still be higher than signal 25 and thus 95 percent process flow will be provided as the set point signal 36 to the flow controller 24. Signal 23 will again be equal to the set point signal 36 and signal 27 will return to 15 pounds which will close the pneumatic control valve 16. Thus, a new operating point will be established at which the recycling of gas from the discharge outlet of the compressor 11 to the suction inlet of the compressor 11 will be minimized. In this manner, the efficiency of the compressor system is increased over the efficiency which was available from prior art control systems. This process is repeated if the process flow should again drop or if the process flow should again rise to 100 percent process flow.

The set point signal 25, which is set at point B on the constant speed curve illustrated in FIG. 1, is utilized only if the process flow should drop to the process flow represented by point B. Thus, the set point 25 establishes a minimum flow rate for the process gas flowing through conduit means 12.

The fast action of the fast controller 24 will prevent the operating point of the compressor from going below the surge line, illustrated in FIG. 1, because the flow controller 24 will generally have the time required for the process flow to drop from at least 95 percent process flow to approximately 70 percent process flow. Even though the change in flow may be rapid, this time will generally be sufficient to allow the flow controller 24 to open the pneumatic control valve 16 and thus prevent compressor surging. In the prior art control system illustrated in FIG. 2, even if the flow controller 24 is a very fast controller, if the set point 25 for the flow controller 24 is set at point B on the constant speed operating curve, there is a very little time for the flow controller 24 to react and surging of the compressor may occur. This possibility is substantially reduced if not eliminated by the control system illustrated in FIG. 3.

The invention is illustrated and described in terms of a single compressor system for the sake of simplicity. The invention is also applicable to multiple compressor systems. The invention is illustrated and described in terms of a specific control system for the compressor but the invention is also applicable to different control system configurations which accomplish the purpose of the invention.

Lines designated as signal lines in the drawings are pneumatic in this preferred embodiment. However, the invention is also applicable to electrical, mechanical, hydraulic or other signal means for transmitting information. In almost all control systems some combination of these types of signals will be used. However, use of any other type of signal transmission, compatible with the process and equipment in use is within the scope of the invention.

The controllers shown may utilize the various modes of control such as proportional, proportional-integral, proportional-derivative, or proportional-integral-derivative. In this preferred embodiment, proportional-integral controllers are utilized but any controller capable of accepting two input signals and producing a scaled output signal, representative of a comparison of the two input signals, is within the scope of the invention. The operation of proportional-integral controllers is well known in the art. The output control signal of a proportional-integral controller may be represented as $$S=K_1E+K_2\int Edt$$

where

S=output control signals;

E=difference between two input signals; and $K_1$ and $K_2$=constants.

The scaling of an output signal by a controller is well known in control systems art. Essentially, the output of a controller may be scaled to represent any desired factor or variable. An example of this is where a desired flow and an actual flow is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 3 to 15 lbs., which is typical, then the output signal could be scaled so that an output signal having a level of 9 lbs. corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other types of equipment or combinations of one or more of such equipment types. While the presently preferred embodiment of the invention preferably utilizes pneumatic control elements, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. In addition, all signals could be translated into a "suppressed zero" or other similar format in order to provide a "live zero" and prevent an equipment failure from being erroneously interpreted as a "low" or "high" measurement or control signal. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

The invention has been described in terms of a preferred embodiment as is illustrated in FIG. 3. Specific components which can be used in the practice of the invention as illustrated in FIG. 3 such as flow sensor 21, flow transducer 22, and pneumatic control valve 16 are each well known, commercially available control components such as are described at length in Perry's Chemical Engineers Handbook, 4th Edition, Chapter 22, McGraw-Hill.

Other preferred components are as follows:

Position controller 31
Model 442RS5236
Taylor Instrument Company

Flow Controller 24
Model 127RF137-(Y2)
Taylor Instrument Company

High select 32
Model SK12381
Taylor Instrument Company

While the invention has been described in terms of the presently preferred embodiment, reasonable variations and modifications are possible by those skilled in the art, within the scope of the described invention and the appended claims. Variations such as using different pressure ranges for the control signals illustrated in FIG. 3 are within the scope of the present invention. Further, a reverse acting control system rather than a direct acting control system could be utilized if desired.

That which is claimed is:

1. Apparatus comprising:

a compressor means having a discharge outlet and a suction inlet;

first conduit means for supplying a gas to the suction inlet of said compressor means;

second conduit means for removing the compressed gas from the discharge outlet of said compressor means;

third conduit means for recirculating gas from said second conduit means to said first conduit means;

a control valve means operably located in said third conduit means;

means for establishing a first signal representative of the flow rate of gas through said first conduit means;

means for establishing a set point signal which varies in response to the position of said control valve means;

means for comparing said first signal and said set point signal and for establishing a second signal responsive to the difference between said first signal and said set point signal; and means for manipulating said control valve means in response to said second signal to thereby control the flow of gas through said third conduit means so as to both prevent surging of said compressor means and substantially minimize the recirculation of gas from said second conduit means to said first conduit means.

2. Apparatus in accordance with claim 1 wherein said means for establishing said set point signal comprises:

means for establishing a third signal representative of the signal required to hold said control valve means substantially fully closed;

means for comparing said second signal and said third signal and for establishing a fourth signal responsive to the difference between said second signal and said third signal;

means for establishing a fifth signal representative of a minimum required flow rate of gas through said first conduit means; and means for comparing said fourth signal and said fifth signal and for establishing said set point signal equal to the higher one of said fourth and fifth signals.

3. Apparatus in accordance with claim 2 wherein said means for comparing said first signal and said set point signal is a first controller means, said means for comparing said second signal and said third signal is a second controller means and said means for comparing said fourth signal and said fifth signal is a high select means.

4. Apparatus in accordance with claim 3 wherein said first controller means includes means for tuning said first controller means and said second controller means includes means for tuning said second controller means, wherein said first controller means is tuned to react from about three to about seven times faster than said second controller means.

5. Apparatus in accordance with claim 3 wherein said first controller means includes means for tuning said first controller means and said second controller means includes means for tuning said second controller means, wherein said first controller means is tuned to react about five times faster than said second controller means.

6. A method for controlling a compressor system in which a control valve is utilized to control the recirculation of gas from the discharge outlet of said compressor system to the suction inlet of said compressor system comprising the steps of:

establishing a first signal representative of the flow rate of gas to the suction inlet of said compressor system;

establishing a set point signal which varies in response to the position of said control valve;

comparing said first signal and said set point signal and establishing a second signal responsive to the difference between said first signal and said set point signal; and manipulating said control valve in response to said second signal to thereby control the recirculation of gas from the discharge outlet of said compressor system to the suction inlet of said compressor system so as to both prevent surging of said compressor system and substantially minimize the recirculation of gas from the discharge outlet of said compressor system to the suction inlet of said compressor system.

7. A method in accordance with claim 6 wherein said step of establishing said set point signal comprises:

establishing a third signal representative of the signal required to hold said control valve substantially fully closed;

comparing said second signal and said third signal and establishing a fourth signal responsive to the difference between said second signal and said third signal;

establishing a fifth signal representative of a minimum required flow rate of gas to the suction inlet of said compressor system; and comparing said fourth signal and said fifth signal and establishing said set point signal equal to the higher one of said fourth and fifth signals, wherein the magnitude of said second signal changes in response to a change in the magnitude of said first signal from about three to about seven times faster than the magnitude of said fourth signal changes in response to a change in the magnitude of said second signal.

8. A method in accordance with claim 6 wherein said step of establishing said set point signal comprises:

establishing a third signal representative of the signal required to hold said control valve substantially fully closed;

comparing said second signal and said third signal and establishing a fourth signal responsive to the difference between said second signal and said third signal;

establishing a fifth signal representative of a minimum required flow rate of gas to the suction inlet of said compressor system; and comparing said fourth signal and said fifth signal and establishing said set point signal equal to the higher one of said fourth and fifth signals, wherein the magnitude of said second signal changes in response to a change in the magnitude of said first signal about five times faster than the magnitude of said fourth signal changes in response to a change in the magnitude of said second signal.

* * * * *